US005535532A

United States Patent [19]

Fujii et al.

[11] Patent Number: 5,535,532

[45] Date of Patent: Jul. 16, 1996

[54] EXCAVATOR CONTROL APPARATUS FOR SHOVEL-TYPE CONSTRUCTION EQUIPMENT

[75] Inventors: Satoshi Fujii; Shoji Tozawa; Tomoaki Ono, all of Tokyo, Japan

[73] Assignee: Shin Caterpillar Mitsubishi Ltd., Tokyo, Japan

[21] Appl. No.: 350,537

[22] Filed: Dec. 7, 1994

[30] Foreign Application Priority Data

Dec. 9, 1993 [JP] Japan ..... 5-340751

[51] Int. Cl.[6] ..... E02F 3/32

[52] U.S. Cl. ..... 37/348; 172/45; 364/424.07

[58] Field of Search ..... 37/348; 172/2, 172/3, 4, 4.5, 7, 9; 364/424.05, 424.07, 424.09; 414/694, 699

[56] References Cited

U.S. PATENT DOCUMENTS

| | | | |
|---|---|---|---|
| 3,643,828 | 2/1972 | Elliott | 214/762 |
| 4,288,196 | 9/1981 | Sutton, II | 37/348 X |
| 4,889,466 | 12/1989 | Jindai et al. | 172/4.5 X |
| 5,160,239 | 11/1992 | Allen et al. | 172/4.5 X |

FOREIGN PATENT DOCUMENTS

| | | |
|---|---|---|
| 0512584 | 11/1992 | European Pat. Off. . |
| 91/02853 | 3/1991 | WIPO . |

*Primary Examiner*—Terry Lee Melius
*Assistant Examiner*—Robert Pezzuto
*Attorney, Agent, or Firm*—Oliff & Berridge

[57] ABSTRACT

An excavator control apparatus for shovel-type construction equipment includes an automatic digging control section, a digging load control device, and an operation command correcting device. The shovel-type construction equipment has a boom, an arm and a bucket that are successively and rotatably connected in an operation section. The boom, the arm and the bucket are each connected to at least one cylinder that extends and retracts according to the operation of a lever. The digging load control device permits an automatic digging routine to be executed by controlling the extension and retraction of the cylinder. The digging load control device transmits operation commands to the cylinder to maintain a digging load approximately equal to a set digging load during automatic digging. The operation command correcting device corrects the operation commands transmitted to the cylinder by manual operation of the lever without cancelling the automatic digging routine.

28 Claims, 5 Drawing Sheets

EXCAVATOR CONTROL APPARATUS FOR SHOVEL-TYPE CONSTRUCTION EQUIPMENT

BACKGROUND OF THE INVENTION

1. Field of the Invention

The present invention relates to construction equipment, e.g., a hydraulic shovel, and, in particular, to an excavator control apparatus.

2. Description of the Related Art

In general, shovel-type construction equipment includes a boom, an arm, and a bucket, which together comprise an operation section and are successively and rotatably connected to the body of the equipment. The boom, the arm and the bucket are each connected to cylinders that can be extended or retracted by operating a lever. Digging with such equipment must be carried out by a very experienced operator because each of the cylinders must be operated simultaneously. Because there are not enough experienced operators today, shovel-type construction equipment in which each of the cylinders is automatically controlled has been proposed. If such equipment is configured to perform an automatic digging routine so that the digging load remains constant, however, a significant variation in digging depth may occur due to changes in the hardness of the ground being dug or the presence of obstacles. As a result, precise digging is difficult to achieve. In particular, when the ground is excavated beyond the intended depth, refilling must take place and, therefore, digging efficiency is considerably reduced. In addition, in correcting the variations in digging depth, the automatic digging control mode must be canceled every time to operate the lever, which results in increased number of digging steps and reduces digging efficiency.

SUMMARY OF THE INVENTION

The excavator control apparatus of the present invention permits an operator to actuate the lever while the equipment is executing an automatic digging routine to adjust various operating conditions, including the digging load, the digging depth, and the location of the digging, without cancelling the automatic digging routine. Accordingly, the automatic digging routine does not need to be reset if the operator actuates the lever.

The excavator control apparatus can be used to control shovel-type construction equipment that has a boom, an arm and a bucket that are successively and rotatably connected in an operation section. The boom, the arm and the bucket are each connected to at least one cylinder that extends and retracts according to the operation of a lever.

The excavator control apparatus includes an automatic digging control section that allows automatic digging by controlling the extension and retraction of the cylinder, a digging load control device that transmits operation commands to the cylinder to maintain a digging load approximately equal to a set digging load during automatic digging, and an operation command correcting device that corrects the operation commands transmitted to the cylinder by the operation of the lever.

The excavator control apparatus can include a depth limiting device that corrects the operation commands transmitted to the cylinder to maintain a digging depth at least as great as a set digging depth, a bucket path control device that transmits operation commands to the cylinder such that a bucket path is approximately aligned with a set path, a first automatic control switching device that switches between a digging load control mode and a bucket path control mode if a digging depth reaches a set digging depth, and a second automatic control switching device that automatically switches between a bucket path control mode and a digging load control mode if a digging overload condition occurs.

The automatic digging control section can be a microcomputer. Operation and speed detecting sensors can be connected to the automatic digging control section to detect the position of the cylinder. A method of controlling equipment with the excavator control apparatus is also disclosed.

BRIEF DESCRIPTION OF THE DRAWINGS

A complete understanding of the present invention may be obtained by reference to the accompanying drawings, when considered in conjunction with the subsequent detailed description thereof, in which.

DESCRIPTION OF PREFERRED EMBODIMENTS

Figure 1:
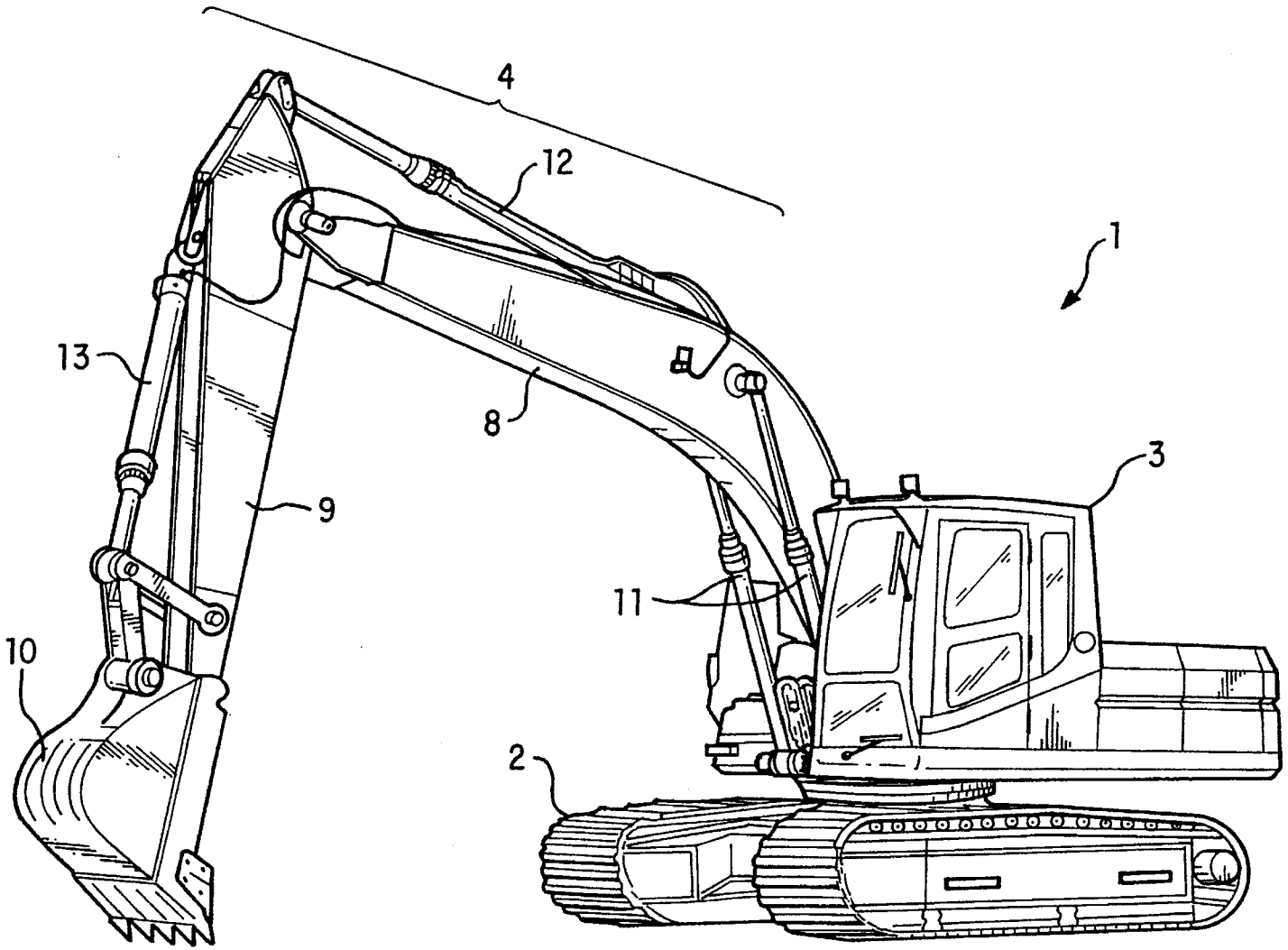
FIG. 1 is a perspective view of a hydraulic shovel.
Figure 2:
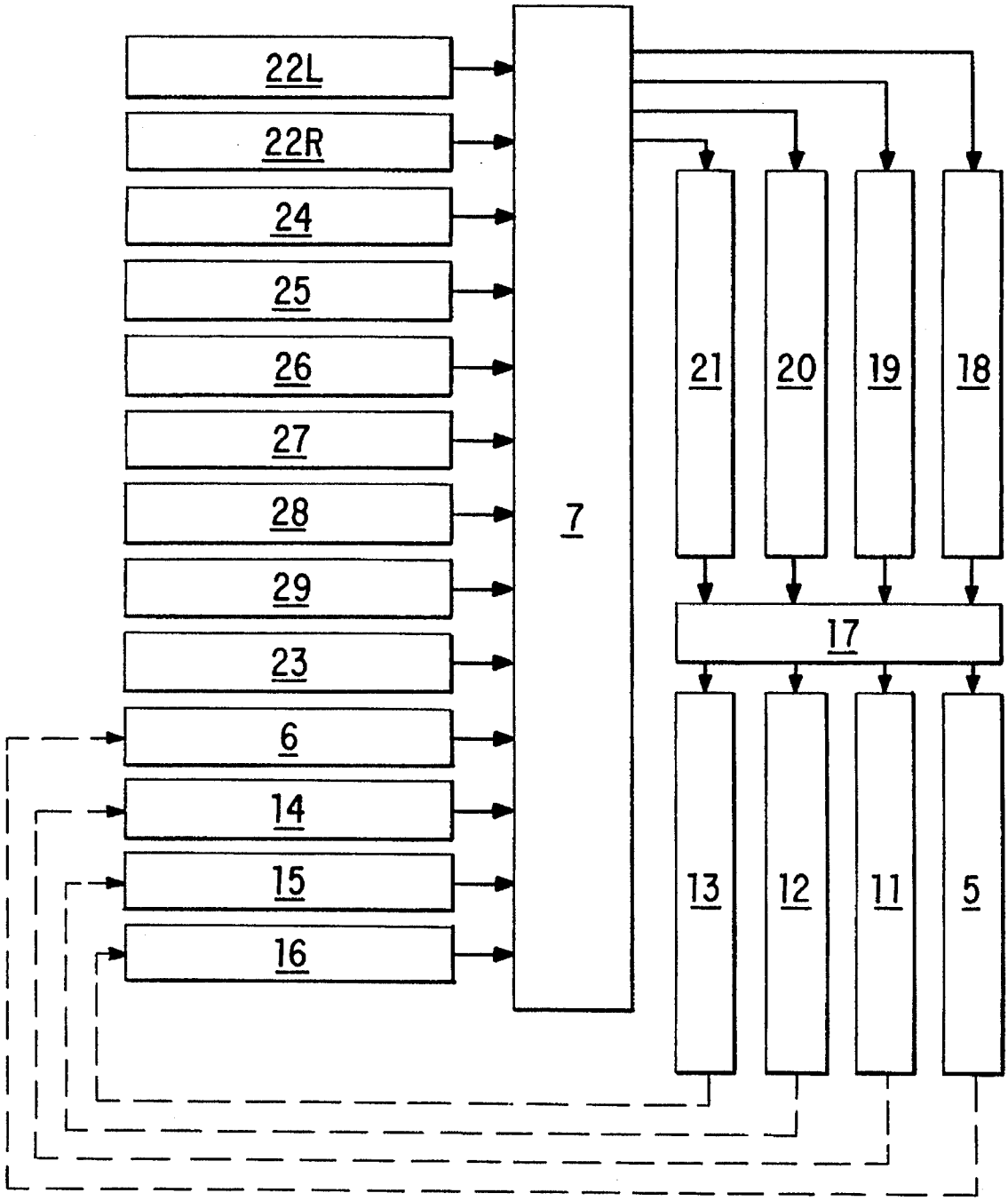
FIG. 2 is a block diagram showing the overall construction of an excavator control apparatus.

Referring to the drawings, and, in particular, to FIG. 1, reference numeral 1 denotes an example of hydraulic shovel-type construction equipment. The hydraulic shovel 1 comprises a tracked moving section 2, a swinging section 3 that is swingably supported on the upper portion of the moving section 2, and an operation section 4 that is connected to the front end portion of the swinging section 3. Each of these sections is operated by hydraulic power supplied by an engine (not shown) disposed in the rear portion of the swinging section 3. Each of the sections is constructed in a conventional manner.

The swinging section 3 is supported on the upper portion of the moving section 2 by swing bearings (not shown). The swinging section 3 swings as a result of the action of a hydraulic motor 5 that engages a set of inner teeth in the swing bearings. The swinging position of the swinging section 3 is detected by a swinging position detecting sensor 6 and transmitted to a control section 7, as described below in greater detail.

The operation section 4 includes a boom 8 that is swingably connected to the front end portion of the swinging section 3 to swing in a vertical direction, an arm 9 that is connected to the front end portion of the boom 8 such that it can swing to-and-fro, a bucket 10 that is connected to the front end portion of the arm 9 such that it can swing to-and-fro, boom cylinders 11 that vary the position of the boom 8, an arm cylinder 12 that varies the position of the arm 9, and a bucket cylinder 13 that varies the position of the bucket 10. Each cylinder 11, 12, and 13 has an operating position and speed detecting sensor 14, 15, and 16, respectively, that detects its operating position and speed and transmits these values to the control section 7.

A control valve 17 allows each of the cylinders 11, 12, and 13 and the motor 5 to be switched. Pilot-operated electromagnetic valves 18, 19, 20, and 21 are each connected, respectively, to the control valve for the hydraulic motor 5 and each of the cylinders 11, 12, and 13, each of which are provided therein. For this reason, the operating speed of the hydraulic motor 5 and each of the cylinders 11, 12, and 13 can be freely controlled by a method that uses PWM (pulse width modulation) to control the current passing through each of the electromagnetic valves 18, 19, 20, and 21.

A pair of operation levers 22L and 22R are disposed on the left and right sides of the operator's seat. Engaging the operating levers 22L and 22R causes the hydraulic motor to tilt the cylinders 11, 12, and 13, individually or together, to the right, left, backward or forward. The operation direction and the operation input of the cylinders are electrically detected and transmitted to the control section 7.

The control section 7 is a microcomputer that includes a CPU, a ROM, and a RAM. The control section 7 causes signals to be transmitted by such component parts as: the swinging position detecting sensor 6, the operating position and speed detecting sensors 14, 15, and 16, the operating levers 22L and 22R; a digging load detecting sensor 23 for detecting the digging load based on the pressure exerted by the arm cylinder 12; an automatic main switch 24 for switching an automatic digging control mode ON and OFF; mode change-over switch for switching automatic digging control modes (including (i) a digging load control mode for executing only a digging load control mode, (ii) a bucket path control mode for executing only a bucket path control mode, and (iii) a combined control mode for automatically switching the digging load control mode and the bucket path control mode); an automatic digging start (end) switch 26 for starting and ending the automatic digging control mode; a digging load setting element 27 for setting a standard load for the digging load control mode; a digging depth setting element 28 for setting a depth limit for the digging load control mode and a standard depth for the bucket path control mode; and an earth-moving position setting element 29 for setting the earth-moving position in the automatic earth-moving control mode.

Judging from the input signals, the control section 7 transmits operation signals to the electromagnetic valves 18, 19, 20, 21, etc. In the control section 7, control procedures for manual operation control have been previously stored. In manual operation control, operation signals based on the operation of the operating levers 22L and 22R in the operation section cause the operation of a corresponding hydraulic actuator (of hydraulic motor 5 or each of the cylinders 11, 12, or 13) to be controlled. In addition, the control section 7 contains previously stored procedures for automatic digging control (digging load control mode, bucket path control mode, and combined control mode), as described below in greater detail, as well as for procedures for automatic earth-moving control in which the bucket 10 is moved from the place where digging is completed to a set earth-moving position to automatically remove earth. The automatic digging control mode has been selected from among the various modes for the purposes of this description.

The automatic digging control mode is executed when the automatic digging start (end) switch 26 is switched (at the location where digging is started) while the automatic main switch 24 is turned on. The control mode is canceled when the automatic digging control operation is completed by switching the automatic digging start (end) switch 26 with the automatic main switch 24 switched off. As described above, the automatic digging control mode of the embodiment includes (i) a digging load mode, (ii) a bucket path control mode, and (iii) a combined control mode. These modes can be alternatively executed by switching a mode change-over switch 25.

Figure 3:
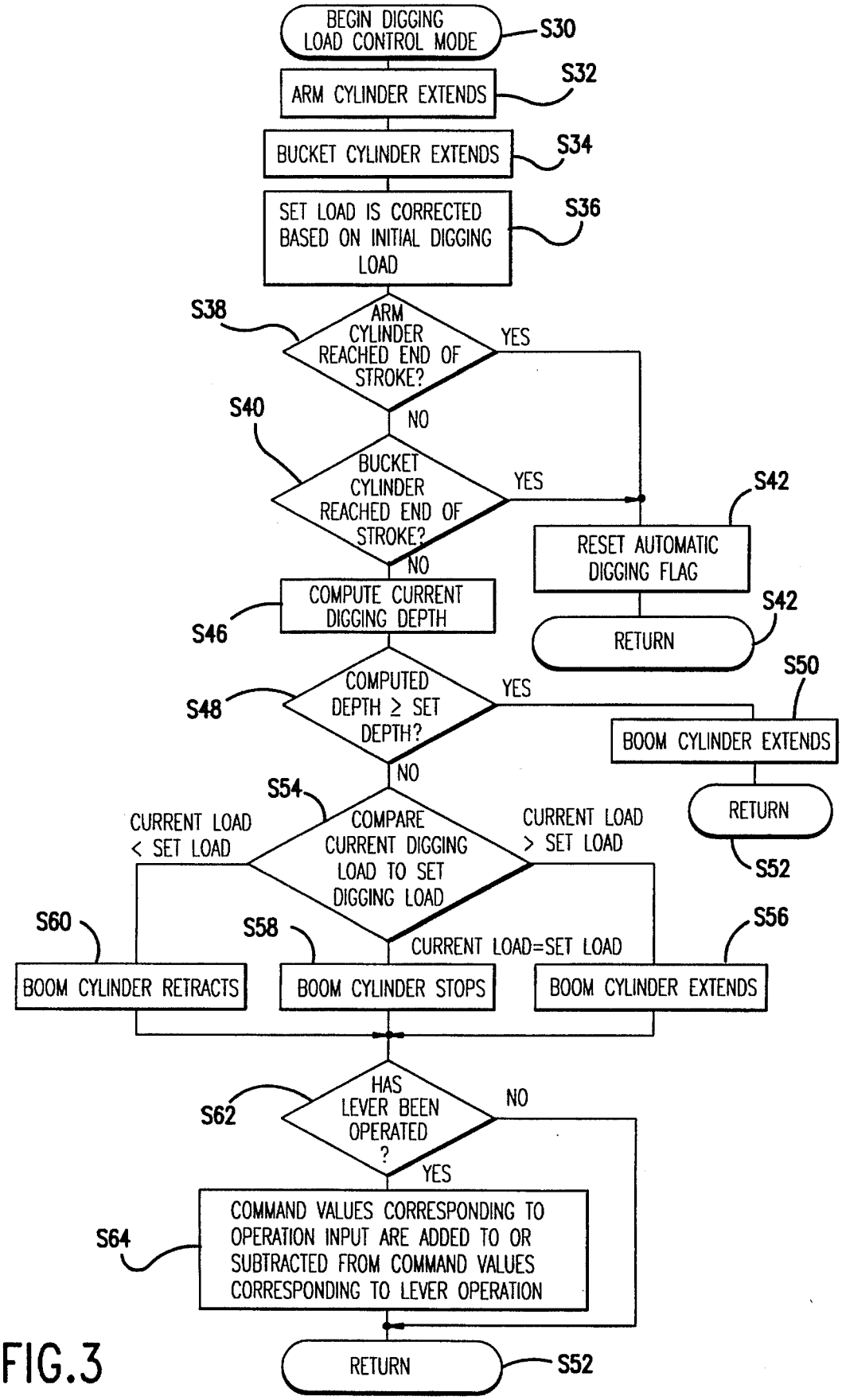
FIG. 3 is a flow chart showing a digging load control mode.

As shown in FIG. 3, when the digging load control mode begins (step S30), a command is transmitted to extend the arm cylinder 12 (step S32) and the bucket cylinder 13 (step S34) for carrying out automatic digging. During automatic digging, the load detected by the digging load detecting sensor 23 and the load set by the digging load setting element 27 are constantly compared with each other (step S54). In one embodiment, since the set load is corrected based on an initial digging load, the corrected set load value is compared with the detected load value (step S36). At the same time, the upward and downward movement of the boom 8 can be controlled based on the compared results. When the detected load and the set load match (i.e., the neutral zone), signals are no longer sent to the boom cylinder 11 (step S58). When the detected load is greater than a set load, a command is transmitted to extend the boom cylinder 11 and reduce the digging load (step S56). When the detected load is less than a set load, however, a command is transmitted to retract the boom cylinder 11 and increase the digging load (step S60). Based on these three factors, a very efficient automatic digging routine can be performed with a constant digging load. The digging load control mode is completed (step S42) when the arm cylinder 12 (step S38) or the bucket cylinder 13 (step S40) reaches the end of its stroke.

In the digging load control mode, the control section constantly determines whether or not the operating lever 22L or 22R has been operated during automatic digging (step S62). When the operating lever has been operated, the command values (electromagnetic valve current values) of the cylinders 11, 12, and 13 are each adjusted depending on the lever operation input (step S64). In other words, even during automatic digging, operating the operating lever 22L or 22R allows the operation position and the operation speed of each of the cylinders 11, 12, and 13 to be freely corrected.

The control section computes the current digging depth based on the detected values of the operation position and speed detecting sensors 14, 15, and 16 (step S46). At the same time, it constantly compares the computed digging depth and the depth set by the digging depth setting element 28 (step S48). When the current digging depth exceeds a set depth, a command is transmitted to the boom cylinder 11 to extend the cylinder. This reduces the digging depth to prevent the ground from being excavated beyond the set depth.

Figure 4:
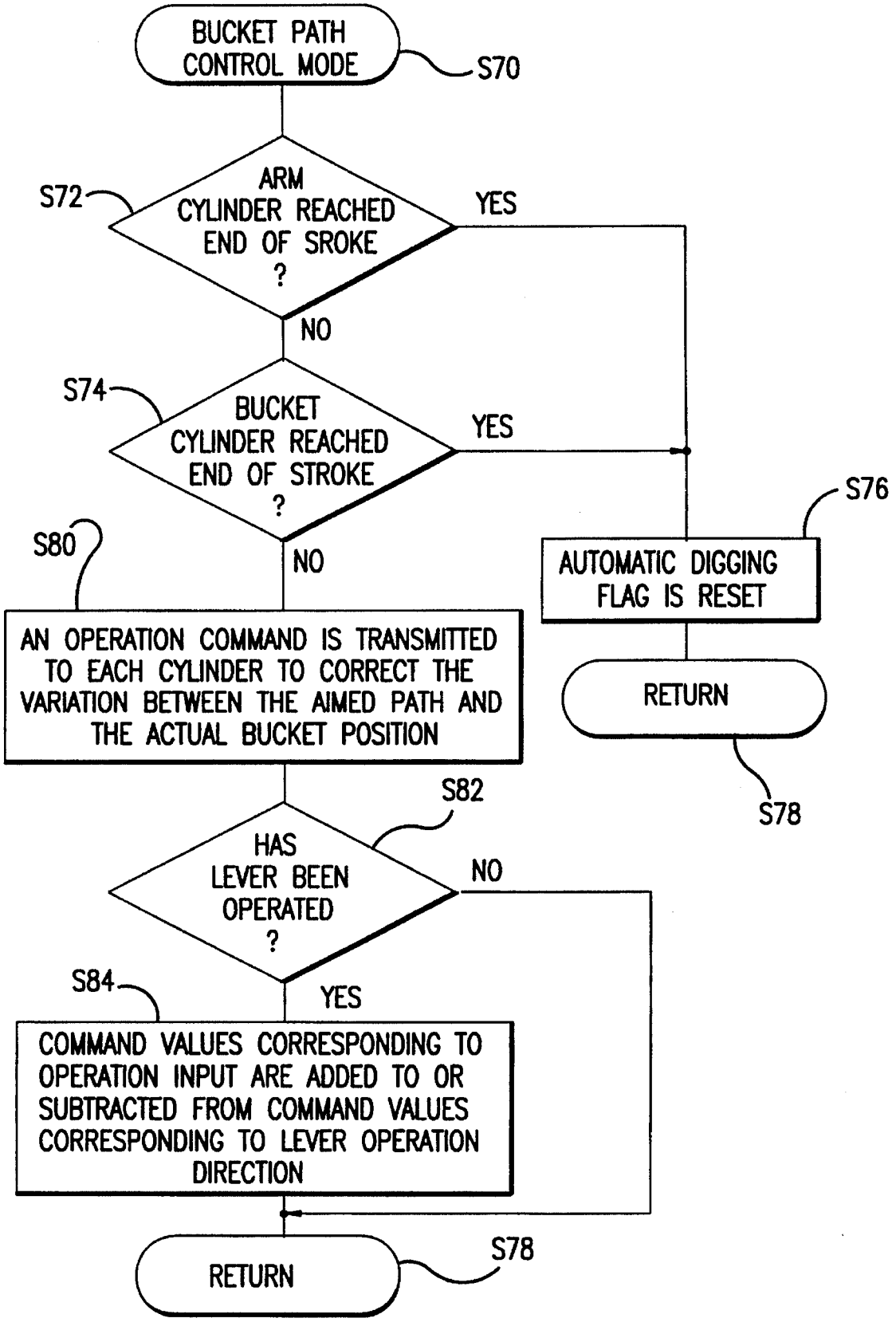
FIG. 4 is a flow chart showing a bucket path control mode.

In the bucket path control mode as shown in FIG. 4, operation command values are transmitted to each of the cylinders 11, 12, and 13 to correct the displacement between the aimed path (linear digging path for maintaining the set depth) and the actual bucket position (computed based on the detected position of each of the cylinders 11, 12, and 13) (step S80). In other words, in the bucket path control mode, since linear control movement is performed on the bucket 10 irrespective of the digging load, automatic digging which is suitable for finish digging can be carried out. Similar to the digging load control mode, the control section 7 determines whether the arm cylinder has reached the end of its stroke (step S72), whether the bucket cylinder has reached the end of its stroke (step S74), and whether the lever has been operated (step S82). If the lever has been operated, the command values corresponding to the operation input of the lever are added or subtracted to the current operation commands (step S84).

Figure 5:
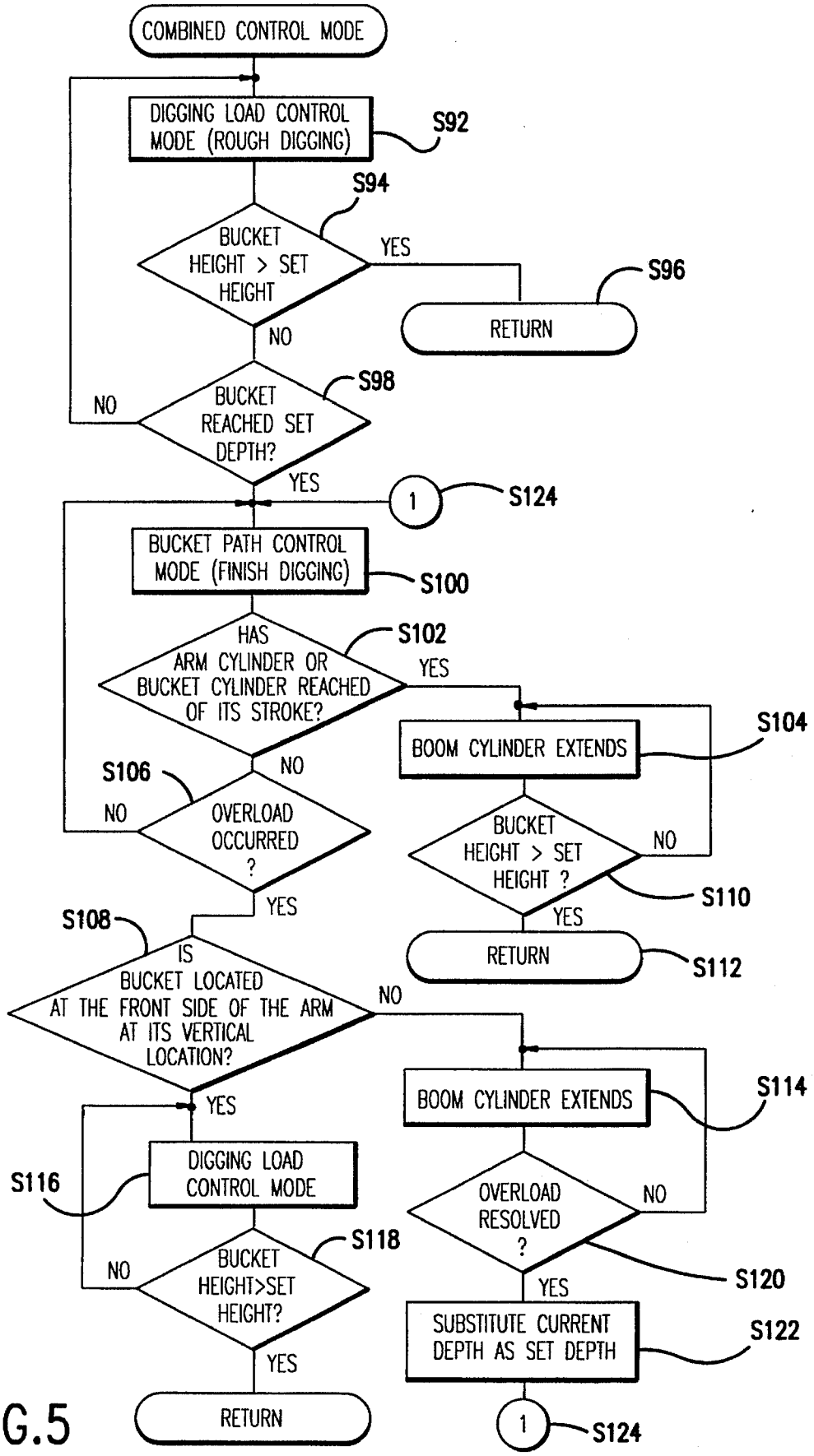
FIG. 5 is a flow chart showing a combined control mode.

According to the combined control mode as shown in FIG. 5, rough digging is performed based on the digging load control mode (step S92). During rough digging, the control section constantly determines whether the bucket 10 has reached the set height (1 meter above ground level in a preferred embodiment) (step S94) and whether the bucket 10 has reached a depth set by the digging depth setting element 28 (step S98). When height of the bucket 10 is determined to have reached the set height (step S96), the combined control mode is temporarily stopped upon judgment that the boom 8 has automatically moved upward when the bucket 10 has become full. When the bucket 10 has been judged to equal a set depth, the rough digging is completed and finish digging is executed (step S100). In addition, in finish digging, when the arm cylinder 12 or the bucket cylinder 13 has reached the stroke end (step S102), or in other words when the bucket 10 has reached the place where digging is completed, a command is transmitted to the boom cylinder to extend it (step S104). This causes the boom 8 to move upward. When the height of the bucket 10 has equalled the set height, the combined control mode is temporarily stopped (step S112). On the other hand, when it has been judged that an overload has occurred before the bucket has reached the location where the digging is completed (comparison is made between a previously set overload value and the value detected by the digging load detecting sensor 23), the control section 7 judges whether the bucket 10 is located at the front side of the arm 9 at its vertical position (step S108). When it has judged that the bucket is not located at the front side, the digging depth at that time is temporarily substituted as the set depth (step S122). The finish digging (bucket path control mode) is continued based on the substituted set depth (step S124). On the other hand, when it has judged that the bucket 10 is located at the front side of the arm 9 at its vertical position (step S108), rough digging (digging load control mode, but the boom 8 is not moved downward) is performed again until the height of the bucket 10 equals the set height (step S118). This procedure is repeatedly carried out assuming that earth removing operations such as automatic earth removal control and manual earth removal operation are to be performed.

In the embodiment of the present invention having such a construction, when the digging load control mode is selected to start automatic digging, variations in digging depth may result due to changes in the hardness of the ground and the presence of obstacles. In the digging load control mode, however, when operating lever 22L or 22R is operated, the command values of the cylinders 11, 12, and 13 which correspond to the lever operation direction are each adjusted depending on the lever operation input. This allows the operation position and the operation speed of each of the cylinders 11, 12, and 13 to be freely changed. As a result, the variations in digging depth arising from automatic digging can be easily corrected by simply operating the operating lever 22L or 22R, without canceling the special automatic digging control mode. Consequently, automatic digging operations can be carried out easily with considerably higher precision.

In the digging load control mode, when the current digging depth exceeds a set depth, an extension command is transmitted to the boom cylinder 11 to decrease the digging depth. At the same time, the digging load at this point is temporarily substituted as the set load. This substitution prevents the digging depth from exceeding the set depth. Accordingly, digging can be carried out with high precision and efficiency because the set load prevents too much earth from being excavated, which would require an additional refilling operation.

In the bucket path control mode, the bucket 10 is controlled to move linearly along the aimed path.

Therefore, after rough digging has be performed in the digging load control mode, finish digging can be performed in the bucket path control mode efficiently with high precision.

The combined control mode allows the mode to be automatically switched from the digging load control mode to the bucket path control mode when the digging depth reaches a set depth, and from the bucket path control mode to the digging load control mode when a digging overload has occurred. Therefore, digging can be carried out precisely and efficiently by repeating both control modes. In addition, digging is easier because manual mode switching is not necessary. Further, any imprecise and inefficient digging that result from erroneous mode switching can be reliably prevented.

Accordingly, because the present invention is constructed as described above, it allows automatic digging to be carried out with the digging load maintained at a set load, while at the same time allowing corrections of the operation commands to be made to each of the cylinders by lever operation. Consequently, variations in the digging depth that arise during automatic digging can be easily corrected by simply operating the levers, without the operator having to undertake the step of canceling the automatic digging control mode. As a result, automatic digging operations can be carried out very easily with very high precision.

The depth limiting means, which is provided to prevent the digging depth from exceeding a set depth, markedly increases the digging precision and efficiency because overdigging is prevented and too much earth will not be excavated.

When the digging load control means for maintaining the digging load during automatic digging at a set load and the bucket path control means for aligning the bucket path and a set path are both provided, after rough digging has been executed in the digging load control mode, finish digging can be executed in the bucket path control mode.

When the control automatic switching device for automatically switching the mode from the digging load control mode to the bucket path control mode when the digging depth has equaled the set depth, or the control automatic switching device for automatically switching the mode from the bucket path control mode to the digging load control mode when a digging overload has occurred are provided, the operation of the invention is simplified because control switching is performed automatically. Accordingly, since improper control switching is prevented, the problems of reduced digging precision and operation efficiency are overcome.

Since other modifications and changes varied to fit particular operating requirements and environments will be apparent to those with skill in the art, the invention is not considered to be limited to the examples chosen for the purpose of disclosure, and thus, the invention covers all changes and modifications that do not constitute a departure from its true spirit and scope.

What is claimed is:

1. An excavator control apparatus for shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder, said automatic digging control section setting a set digging load for automatic digging;

digging load control means for sensing a digging load on said boom, said arm and said bucket and transmitting operation commands to said at least one cylinder to maintain the sensed digging load approximately equal to the set digging load during automatic digging; and operation command correcting means for correcting said operation commands transmitted to said at least one cylinder, the operation command correcting means being activated by the operation of said lever.

2. An excavator control apparatus for shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder, said automatic digging control section setting a set digging load for automatic digging;

digging load control means for sensing a digging load on said boom, said arm and said cylinder and transmitting operation commands to said at least one cylinder to maintain the sensed digging load approximately equal to the set digging load during automatic digging; and depth limiting means for correcting said operation commands transmitted to said at least one cylinder to maintain a digging depth less than a set digging depth.

3. An excavator control apparatus for shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder, said automatic digging control section setting a set digging load for automatic digging;

digging load control means for sensing a digging load on said boom, said arm and said cylinder and transmitting operation commands to said at least one cylinder to maintain the sensed digging load approximately equal to the set digging load during automatic digging; and bucket path control means for transmitting operation commands to said at least one cylinder such that a bucket path is approximately aligned with a set path.

4. The excavator control apparatus of claim 3, wherein said automatic digging control section includes control switching means for switching between a digging load control mode and a bucket path control mode.

5. The excavator control apparatus of claim 3, wherein said automatic digging control section includes automatic control switching means for automatically switching between a digging load control mode and a bucket path control mode if a digging depth reaches a set digging depth.

6. The excavator control apparatus of claim 3, wherein said automatic digging control section includes automatic control switching means for automatically switching between a bucket path control mode and a digging load control mode if a digging overload condition occurs.

7. The excavator control apparatus of claim 3, wherein said automatic digging control section includes first automatic control switching means for automatically switching between a digging load control mode and a bucket path control mode if a digging depth reaches a set digging depth, and second automatic control switching means for automatically switching between a bucket path control mode and a digging load control mode if a digging overload condition occurs.

8. An excavator control apparatus for shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder;

digging load control means for transmitting operation commands to said at least one cylinder to maintain a digging load approximately equal to a set digging load during automatic digging;

operation command correcting means for correcting said operation commands transmitted to said at least one cylinder by the operation of said lever;

depth limiting means for correcting said operation commands transmitted to said at least one cylinder to maintain a digging depth less than a set digging depth;

bucket path control means for transmitting operation commands to said at least one cylinder such that a bucket path is approximately aligned with a set path;

first automatic control switching means for automatically switching between a digging load control mode and a bucket path control mode if a digging depth reaches a set digging depth; and second automatic control switching means for automatically switching between a bucket path control mode and a digging load control mode if a digging overload condition occurs.

9. An excavator control apparatus for shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder;

a digging load control device that transmits operation commands to said at least one cylinder to maintain a digging load approximately equal to a set digging load during automatic digging; and a command adjusting circuit that adjusts said operation commands transmitted to said at least one cylinder.

10. The excavator control apparatus of claim 9, wherein said command adjusting circuit is an operation command correcting circuit, said operation command correcting circuit correcting said operation commands according to commands input by said lever.

11. The excavator control apparatus of claim 9, wherein said command adjusting circuit is a depth limit maintaining circuit that corrects said operation commands transmitted to said at least one cylinder to maintain a digging depth less than a set digging depth.

12. The excavator control apparatus of claim 9, wherein said command adjusting circuit is a bucket path control circuit that transmits operation commands to said at least one cylinder such that said bucket operates along a bucket path approximately aligned with a set bucket path.

13. The excavator control apparatus of claim 12, wherein said automatic digging control section includes a control switching device that switches between a digging load control mode and a bucket path control mode.

14. The excavator control apparatus of claim 12, wherein said automatic digging control section includes an automatic control switching device that automatically switches between a digging load control mode and a bucket path control mode if a digging depth reaches a set digging depth.

15. The excavator control apparatus of claim 12, wherein said automatic digging control section includes an automatic control switching device that automatically switches between a bucket path control mode and a digging load control mode if a digging overload condition occurs.

16. The excavator control apparatus of claim 12, wherein said automatic digging control section includes a first automatic control switching device that automatically switches between a digging load control mode and a bucket path control mode if a digging depth reaches a set digging depth, and a second automatic control switching device that automatically switches between a bucket path control mode and a digging load control mode if a digging overload condition occurs.

17. A method for controlling shovel-type construction equipment with an excavator control apparatus, said shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder; and a digging load control device for transmitting operation commands to said at least one cylinder to maintain a digging load approximately equal to a set digging load during automatic digging;

a command adjusting circuit that adjusts said operation commands transmitted to said at least one cylinder;

said method comprising the step of:

correcting said operation commands transmitted to said at least one cylinder based upon a signal input to said automatic digging control section.

18. The method of claim 17, wherein said step of correcting includes correcting said operation commands based upon the operation of said lever.

19. The method of claim 17, wherein said step of correcting includes correcting said operation commands such that a digging depth is less than a set digging depth.

20. The method of claim 17, wherein said step of correcting includes correcting said operation commands such that said bucket operates along a bucket path that is approximately aligned with a set path.

21. The method of claim 20, wherein said automatic digging control section includes a control switching device that switches between a digging load control mode and a bucket path control mode.

22. The method of claim 20, wherein said automatic digging control section includes an automatic control switching device that automatically switches between a digging load control mode and a bucket path control mode if a digging depth reaches a set digging depth.

23. The method of claim 20, wherein said automatic digging control section includes an automatic control switching device that automatically switches between a bucket path control mode and a digging load control mode if a digging overload condition occurs.

24. The method of claim 20, wherein said automatic digging control section includes a first automatic control switching device that automatically switches between a digging load control mode and a bucket path control mode if a digging depth reaches a set digging depth, and a second automatic control switching device that automatically switches between a bucket path control mode and a digging load control mode if a digging overload condition occurs.

25. The method of claim 18, wherein said step of correcting occurs without cancelling automatic digging.

26. An excavator control apparatus for shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder;

digging load control means for transmitting operation commands to said at least one cylinder to maintain a digging load approximately equal to the set digging load during automatic digging; and operation command correcting means for correcting said operation commands transmitted to said at least one cylinder during digging load control upon detection of and in response to the operation of said lever without interrupting said digging load control.

27. An excavator control apparatus for shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder;

digging load control means for transmitting operation commands to said at least one cylinder to maintain a digging load approximately equal to a set digging load during automatic digging; and depth limiting means for correcting said operation commands transmitted to said at least one cylinder during digging load control in accordance with a set digging depth when a digging depth is detected to be greater than said set digging depth without interrupting said digging load control.

28. An excavator control apparatus for shovel-type construction equipment having a boom, an arm and a bucket that are successively and rotatably connected in an operation section, each of said boom, said arm and said bucket being connected to at least one cylinder that extends and retracts according to the operation of a lever, said excavator control apparatus comprising:

an automatic digging control section that allows automatic digging by controlling the extension and retraction of said at least one cylinder;

digging load control means for transmitting operation commands to said at least one cylinder to maintain a digging load approximately equal to a set digging load during automatic digging; and bucket path control means for transmitting operation commands to said at least one cylinder during digging load control in accordance with maintaining a bucket path in alignment with a set bucket path when the bucket is detected to reach a set depth without interrupting said digging load control.

* * * * *